United States Patent [19]

Sekiguchi

[11] 4,283,151

[45] Aug. 11, 1981

[54] COMPOUND WRITING INSTRUMENT

[75] Inventor: Kazuhiko Sekiguchi, Tokyo, Japan

[73] Assignee: Zebra Co., Ltd., Tokyo, Japan

[21] Appl. No.: 127,982

[22] Filed: Mar. 6, 1980

Related U.S. Application Data

[63] Continuation of Ser. No. 972,484, Dec. 22, 1978, abandoned.

[51] Int. Cl.[3] ..... B43K 27/14

[52] U.S. Cl. ..... 401/33

[58] Field of Search ..... 401/16, 17, 19, 21, 401/29, 30–33

[56] References Cited

U.S. PATENT DOCUMENTS

| | | | |
|---|---|---|---|
| 2,826,173 | 3/1958 | Gossweiler et al. | 401/33 |
| 2,928,374 | 3/1960 | Bergonzo | 401/33 |
| 3,274,976 | 9/1966 | Levoin | 401/31 |
| 3,299,857 | 1/1967 | Sears | 401/33 |
| 3,797,945 | 3/1974 | Zepell | 401/33 |

*Primary Examiner*—John D. Yasko

*Attorney, Agent, or Firm*—Wenderoth, Lind & Ponack

[57] ABSTRACT

A compound writing instrument, wherein a retractable mechanical pencil unit and a ball point pen unit are assembled in a lower barrel of the writing instrument, an upper barrel rotatable in one or two directions relative to said lower barrel around its axis overlaps said lower barrel and a cam mechanism engaging with said units for selectively shifting said units in the axial direction into a writing position is accomodated within said upper barrel of the writing instrument. By means of said cam mechanism, said upper barrel is shiftable relative to said lower barrel in the axial direction enough to feed out the lead of said mechanical pencil unit when this unit is in the writing position, while said upper barrel is non-shiftable relative to said lower barrel when said ball point pen unit is in the writing position.

4 Claims, 19 Drawing Figures

COMPOUND WRITING INSTRUMENT

This is a continuation of application Ser. No. 972,484, filed Dec. 22, 1978, now abandoned.

BACKGROUND OF THE INVENTION

In the prior art, there is known a writing instrument having a lower barrel having mounted therein two colored ball point pen units and an upper barrel provided with a cam mechanism engaging with said units. By turning said upper barrel through a certain angle around the axis of the barrel, said units can be selectively shifted into a writing position or retracted position.

However, in said cam mechanism of the writing instrument, the upper barrel can not be shifted in the axial direction, so that even if one of said ball point pen units is replaced by a mechanical pencil unit, the feeding out of the lead can not be effected by axial shifting of the upper barrel.

SUMMARY OF THE INVENTION

In view of the above mentioned circumstances, this invention was made for the purpose of providing a compound writing instrument, wherein by rotating the upper barrel in one or the other direction around the axis of the barrel, the mechanical pencil unit and the ball point pen unit are selectively shifted into and out of the writing position and by means of the cam mechanism mounted within the upper barrel of the writing instrument, the upper barrel is shiftable relative to said lower barrel in the axial dirction enough to feed out the lead of the mechanical pencil unit when this unit is in the writing position, while the upper barrel is nonshiftable relative to the lower barrel when the ball point pen unit is in the writing position. Thus, the structure of the writing instrument is made simple and selective shifting of the writing units into the writing positions is smoothly and surely effected as well as the feed out operation of lead by an axial sliding system.

Thus, this invention relates to a compound writing instrument having a retractable mechanical pencil unit and a ball point pen unit, which are accommodated within a common barrel, and characterized in that the retractable mechanical pencil unit and the ball point pen unit are assembled within a lower barrel of the writing instrument, an upper barrel is rotatable in one or the other direction relative to said lower barrel around the axis of said barrel and overlaps said lower barrel and a cam mechanism engaging with said units for selectively shifting said units in the axial direction into a writing position is accommodated within the upper barrel of the writing instrument, and by means of said cam mechanism, said upper barrel is shiftable relative to said lower barrel in the axial direction enough to feed out the lead of said mechanical pencil unit when this unit is in the writing position, while said upper barrel is non-shiftable relative to said lower barrel when said ball point pen unit is in the writing position.

DESCRIPTION OF THE PREFERRED EMBODIMENTS

Figure 1:
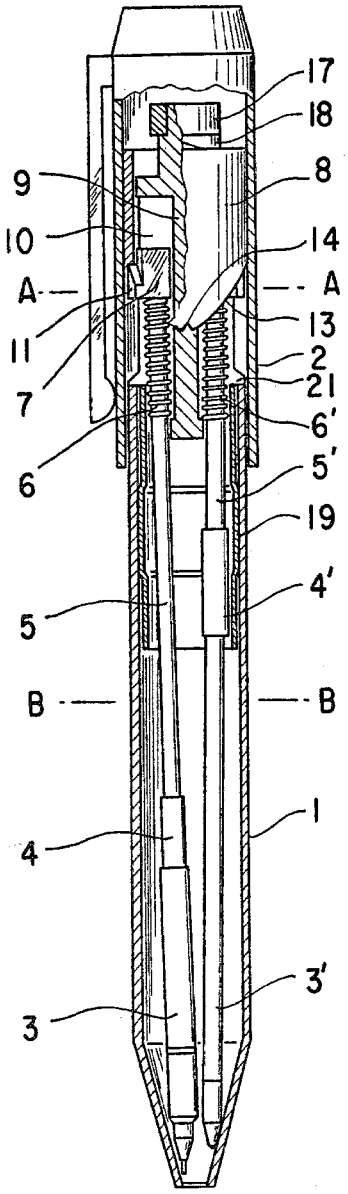
FIG. 1(A) is a partly broken away sectional view of an upper barrel and a lower barrel of a compound writing instrument according to the first embodiment of this invention, showing the inner structure in a state in which a pencil unit and a ball point pen unit are in a retracted position.
FIG. 1(B) is a view similar to FIG. 1(A) of a second embodiment of this invention.
Figure 1:
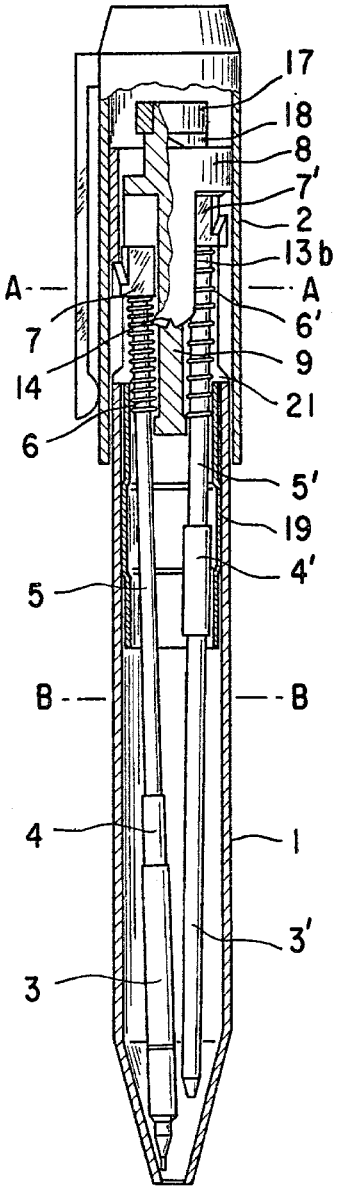
Figure 2A:
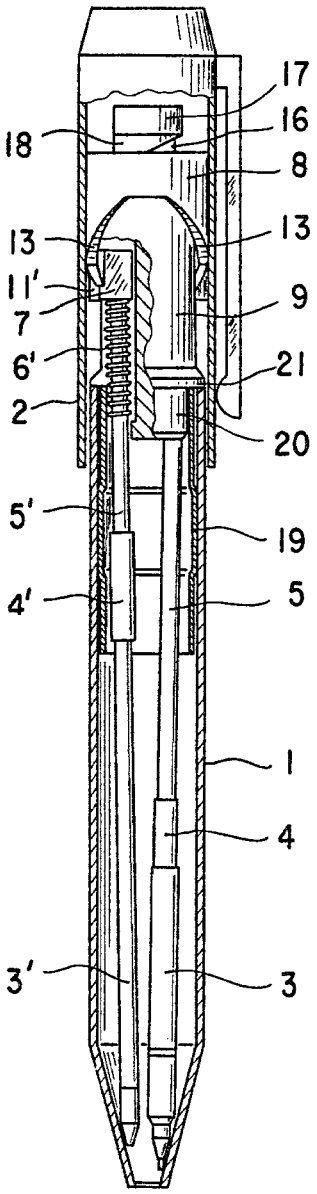
FIG. 2(A) is a view similar to FIG. 1(A), showing the back side of the instrument of FIG. 1(A)
Figure 2B:
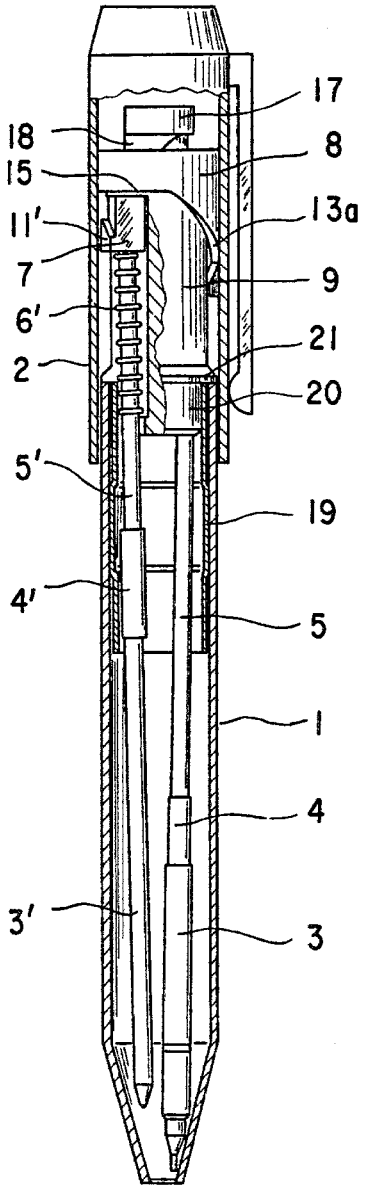
FIG. 2(B) is a view similar to FIG. 2(A) showing the back side of the instrument of FIG. 1(B)

The first embodiment of this invention is shown in FIG. 1(A) to FIG. 10(A) inclusive, in which 1 denotes a lower barrel, within which a mechanical pencil unit 3 and a ball point pen unit 3′ are accommodated. The rear ends of these units 3 and 3′ are connected with rods 5 and 5′ through connecting sleeves 4 and 4′ and sliders 7 and 7′ are provided on upper end of said rods 5 and 5′.

In an upper cavity of the lower barrel 1, a coupling sleeve 19 is tightly inserted, within which a lower tube 20 of a guide sleeve 9 is also tightly inserted. An annular projection 21 formed on the guide sleeve 9 abuts the upper end face of the lower barrel 1 to serve as a stop. Thus, the lower barrel 1 and the guide sleeve 9 are solidly connected together.

Figure 10A:
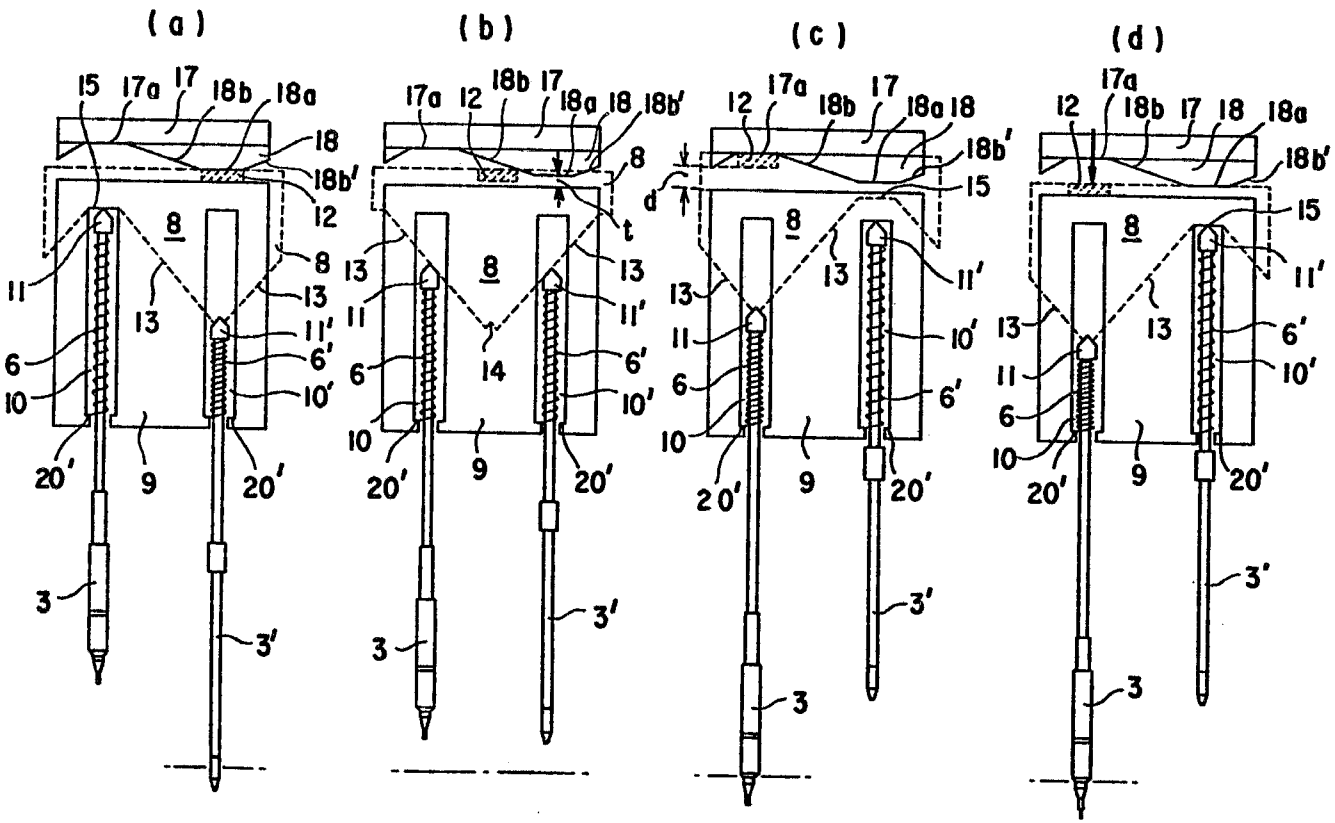
FIGS. 10(A), (*a*), (*b*), (*c*) and (*d*) are explanatory developed views for explaining the movement both of the mechanical pencil unit and the ball point pen unit into the writing position, the retaining position and the lead feeding out position with respect to the cam mechanism for the embodiment of FIG. 1(A)
Figure 10:
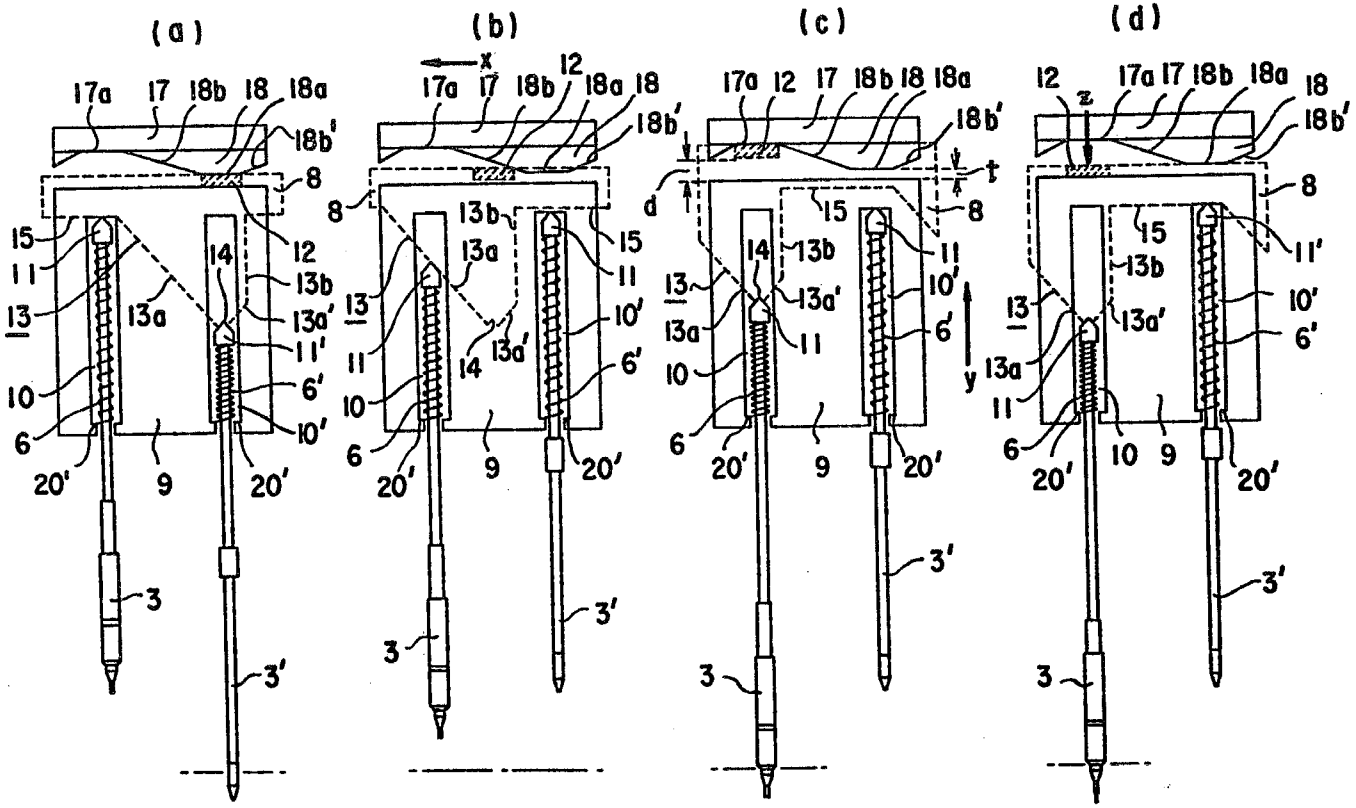
FIGS. 10(B) (*a*), (*b*), (*c*) and (*d*) are respectively views similar to FIGS. 10(A), (*a*), (*b*), (*c*) and (*d*) for the embodiment of FIG. 1(B).

The guide sleeve 9 is cylindrical and is provided with guide grooves 10 and 10′ (FIG. 10(A)) which are diametrically opposed to each other to guide the sliders 7 and 7′ in the axial direction. Within these guide grooves 10 and 10′, the sliders 7 and 7′ are elastically held coiled springs 6 and 6' which are provided on the rods 5 and 5' and are guided in the axial direction by said guide grooves 10 and 10'. Lower portions of the guide grooves 10 and 10' are reduced in width to form a stepped portion 20', on which the lower ends of said coiled springs 6 and 6' are supported.

On the upper portion of the guide sleeve 9, a head portion 16 is formed via a stepped portion, and on the peripheral side of said head portion 16, a cam 18 is formed, the configuration of which is shown in FIG. 9(A) and the developed view of FIG. 10(A). As is apparent from FIG. 10(A), said cam 18 comprises a lowermost flat face 18*a* and inclined faces 18*b* and 18*b'* on both sides of said flat face, and the angles of inclination of these inclined faces are equal and said cam 18 is formed not on the whole periphery of the head portion 16, but is formed on a portion other than a portion 17*a* which corresponds to the central inside face of a sector stop 12 on a curved casing 8 to be described later.

As shown in FIG. 1(A) to FIG. 4(A) and FIG. 9(A), the guide sleeve 9 is slidably inserted in a curved casing 8, on which sliding cam faces are formed as is apparent particularly from FIG. 9(A) and FIG. 10(A). As seen from the figures, these sliding cam faces are formed with a flat portion 15 on their top portion, inclined faces 13 and 13 formed symmetrically with respect to said flat portion 15, and a notched engaging portion 14 is formed at the junction of these two inclined faces 13 and 13. The notched engaging portion 14 is so formed that it can have engaged therein the tips of pointed engaging portions 11 and 11' which are provided on the surfaces of said sliders 7 and 7'. The inclined faces of these pointed engaging portions 11 and 11' engage with the sliding cam face and slide in response to the rotation of the curved casing 8.

Figure 7A:
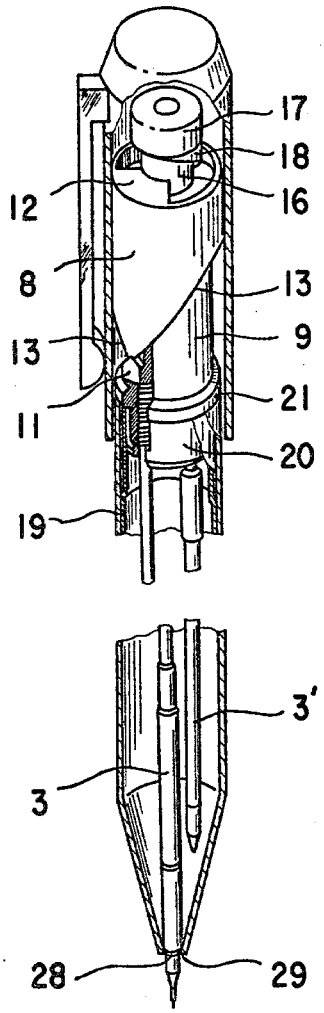
FIG. 7(A) is a broken perspective view, showing a cam mechanism of the embodiment of FIG. 1(A)
Figure 7B:
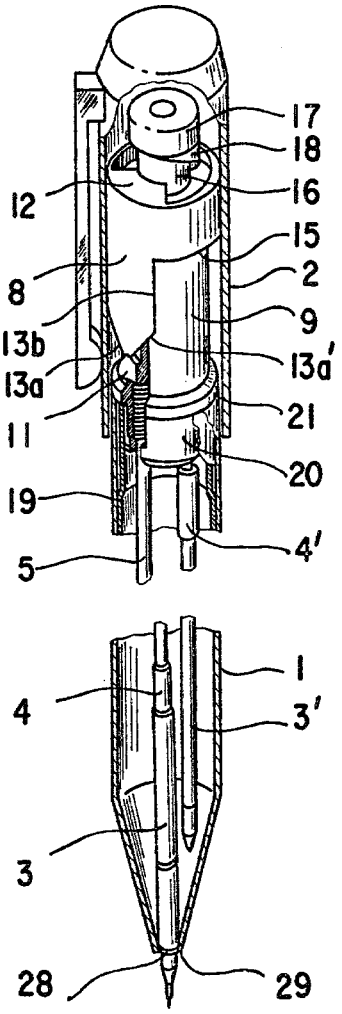
FIG. 7(B) is a view similar to FIG. 7(A), showing the cam mechanism of the embodiment of FIG. 1(B)

On the other hand, as seen from FIG. 6(A), FIG. 7(A) and FIG. 9(A), a sector stop 12 is provided on the upper end of the curved casing 8 and projects inwardly therefrom. This stop 12 engages with the cam 18 on the head portion 16.

Figure 3A:
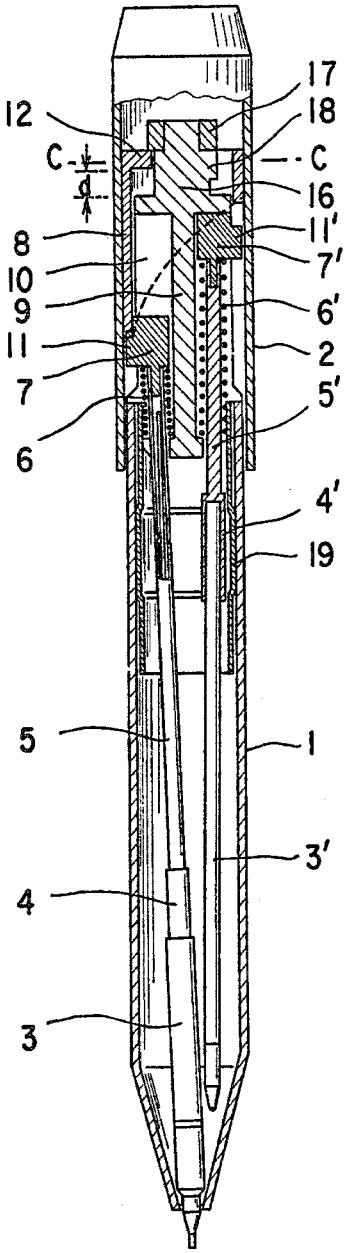
FIG. 3(A) is a view similar to FIG. 1(A), showing the pencil unit in a writing position after the rotation of the upper barrel.
Figure 3:
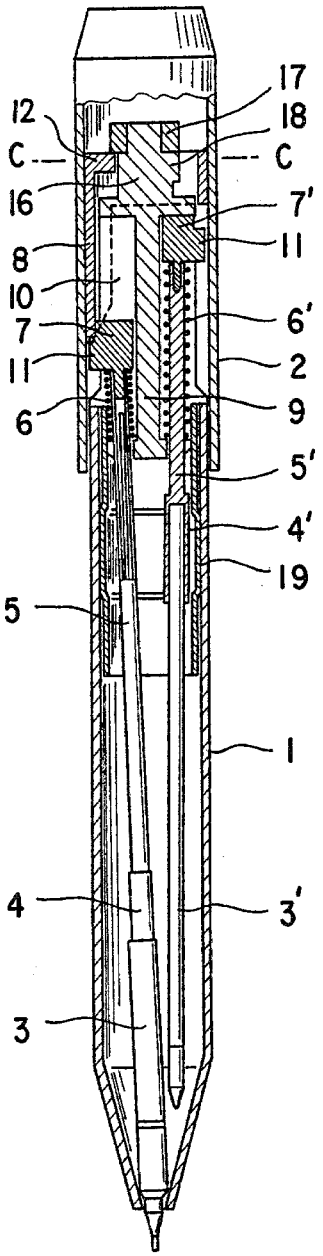
FIG. 3(B) is a view similar to FIG. 3(A) but showing the instrument of FIG. 1(B)
Figure 4:
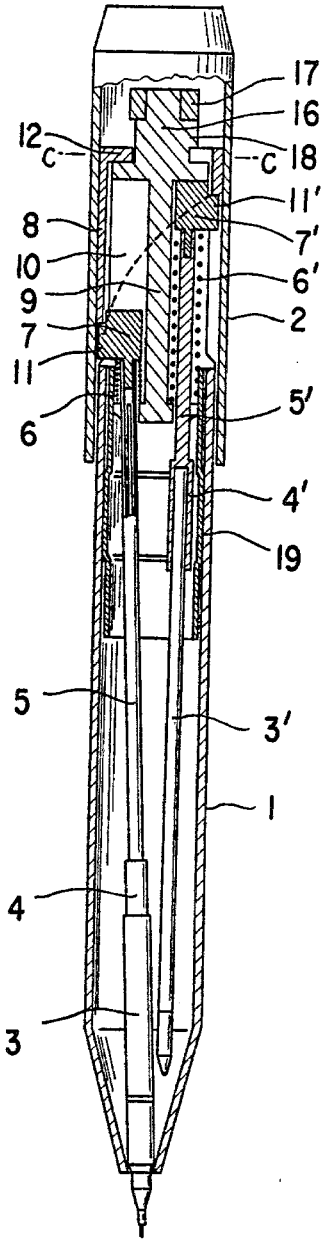
FIG. 4(A) is a view similar to FIG. 3(A), showing the pencil unit shifted downward in the axial direction for feeding out of the lead.
FIG. 4(B) is a view similar to FIG. 4(A) but showing the instrument of FIG. 1(B)
Figure 4:
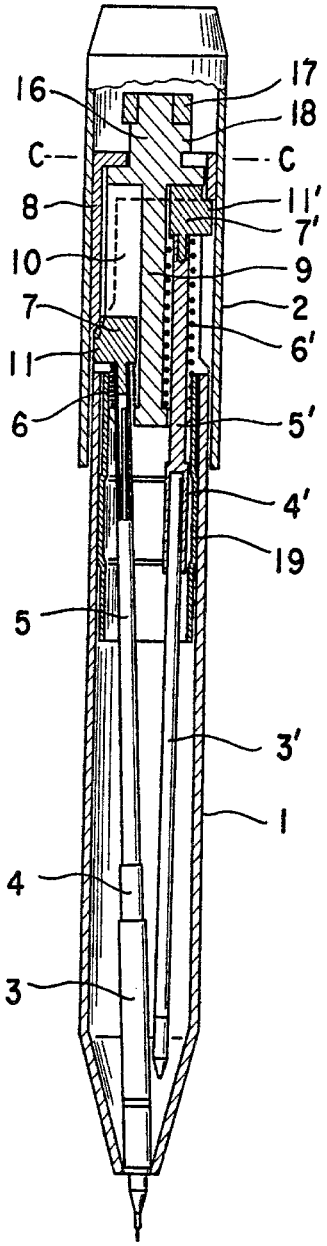
Figure 5A:
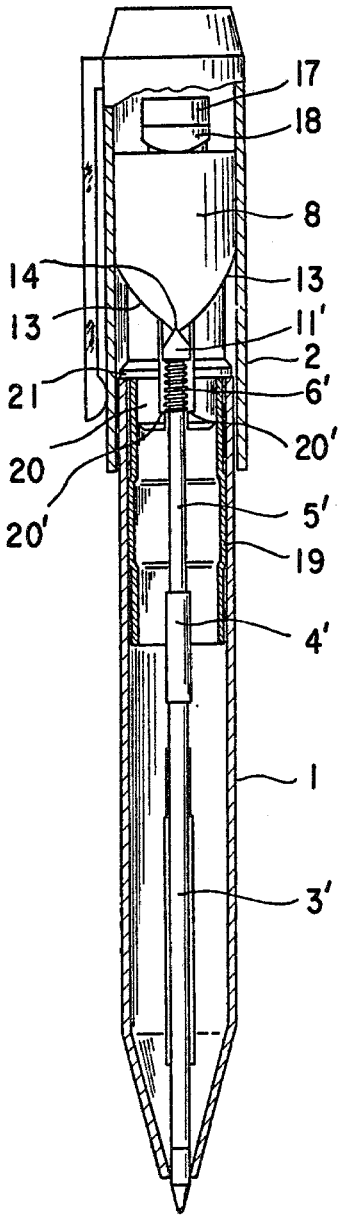
FIG. 5(A) is a view similar to FIG. 3(A) seen from the side of the casing.
Figure 5B:
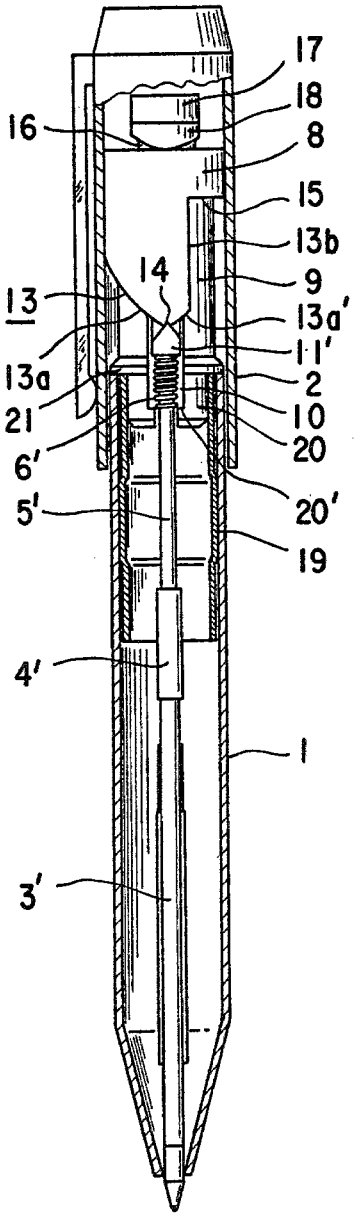
FIG. 5(B) is a view similar to FIG. 5(A) but showing the instrument of FIG. 1(B)
Figure 6:
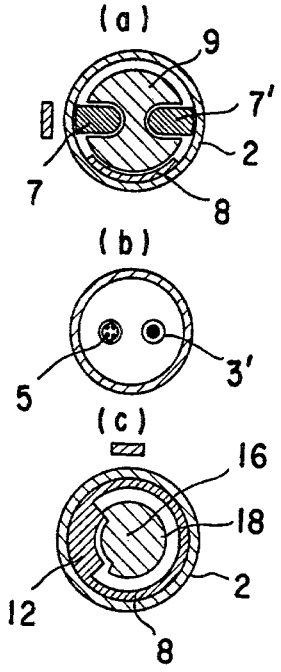
FIG. 6(*a*) is a sectional view taken along line A—A of FIG. 1(A) and FIG. 1(B), FIG. 6(*b*) is a sectional view taken along line B—B of FIG. 1(A) and FIG. 1(B),and FIG. 6(*c*) is a sectional view taken along line C—C of FIG. 3(A) and FIG. 3(B)
Figure 6:
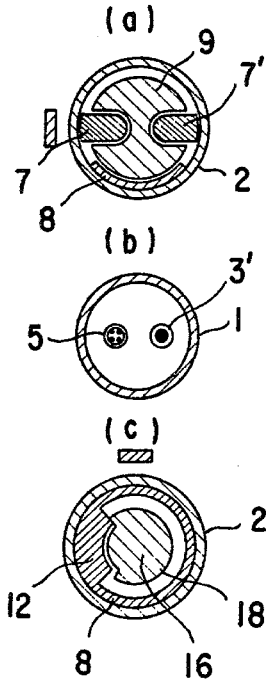

A fixing ring 17 is fitted on the head portion 16 after the curved casing 8 is put on the outside of the guide sleeve 9 (FIG. 3(A), FIG. 4(A)). The fixing ring 17 cooperates with the sector stop 12 and serves to prevent upward shifting of the curved casing 8 due to the urging force of the springs 6 and 6', when the curved casing 8 is brought to a position shown in FIG. 3(A).

The upper barrel 2 is secured to the periphery of the curved casing 8 and the lower end of the barrel 2 slidably overlaps the upper end of the lower barrel 1. As described hereinafter, the curved casing 8 is rotatable in either of two directions, right and left, around the axis of the barrel relative to the guide sleeve 9, and when the mechanical pencil unit 3 is in the writing position, it is shiftable within certain limits in the axial direction, so that the upper barrel 2 is similarly rotatable in either of two directions relative to the lower barrel (which is fixed to the guide sleeve 9, and when the pencil unit 3 is in the writing position, it is shiftable within certain limits in the axial direction (details thereof will be given hereinafter).

Figure 8:
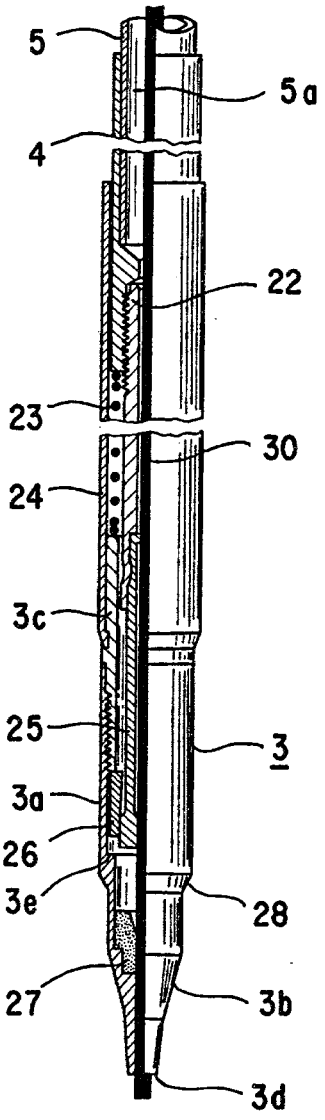
FIG. 8 is a partly broken sectional view, showing the inner struction of a mechanical pencil unit common to both the embodiments.
Figure 9:
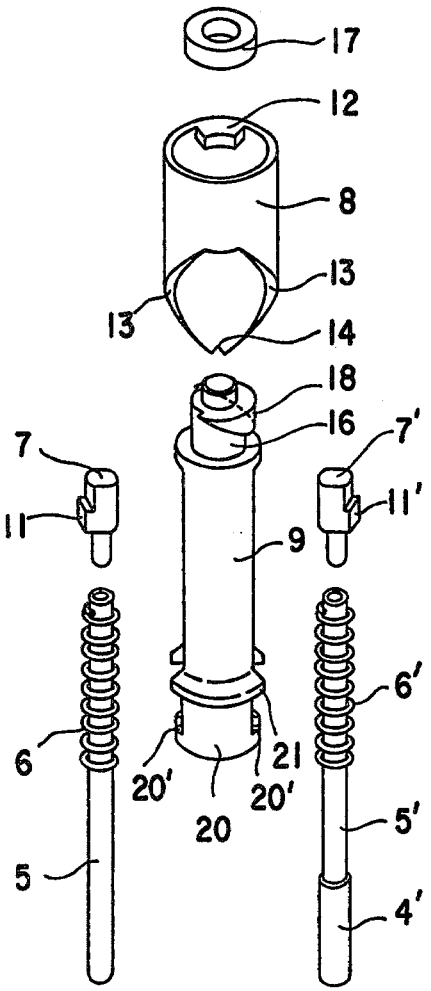
FIG. 9(A) is an explanatory exploded view of each element of the cam mechanism of the embodiment of FIG. 1(A)
FIG. 9(B) is a view similar to FIG. 9(A) of the embodiment of FIG. 1(B)
Figure 9:
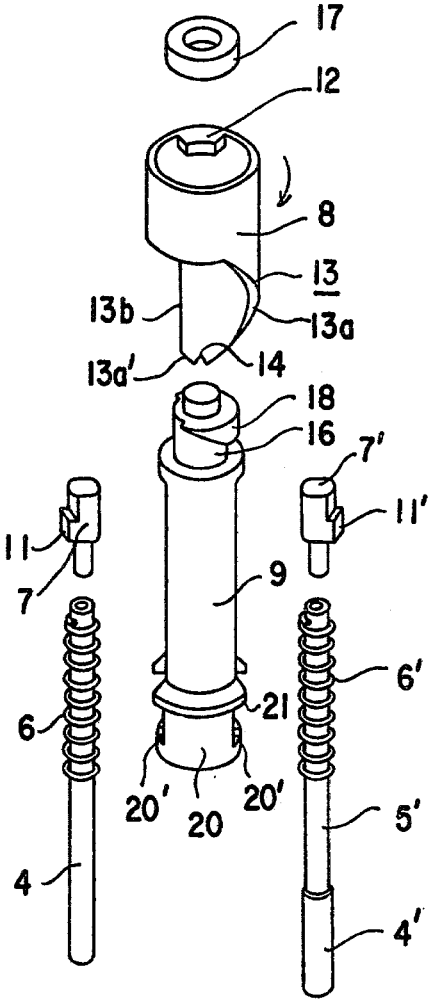

The mechanical pencil unit 3 has a chuck mechanism shown in FIG. 8, wherein 5 denotes said rod, and which also serves as a magazine for the lead 30. On the lower outside of the rod 5, a connecting sleeve 4 is fixed, and an intermediate sleeve 22 is secured to lower inside of the sleeve 4, and a split pawl chuck 25 is secured to said sleeve 22. On the tip portion of pencil body casing 3*a*, a pencil tip mouth piece 3*b* is formed. A connecting tube 3*c* is connected to the upper portion of said casing 3*a*, and a spring 23 is interposed between the upper end of the tube 3*c* and the lower end of the connecting sleeve 4. A cover casing 24 covers the connecting sleeve 4 and the connecting tube 3*c*, and constitutes a part of the pencil body casing 3*a*. In a space between the lower end of the connecting tube 3*c* and an abutting stepped portion 3*e*, a clamping sleeve 26 which cooperates with the chuck 25 is slidably inserted and the aperture in a cavity of the sleeve 26 is tapered so as to gradually enlarge toward the tip mouth piece 3*b*, 27 denotes a rubber-like elastic supporting ring inserted in the tip mouth piece 3*b*. On upper portion of the tip mouth piece 3*b*, an abutting stop portion 28 is formed which abuts against inside of a tip mouth 29 of the lower barrel when the pencil body 3 is shifted towards the tip mouth 29 of the lower barrel 1 for the purpose of feeding the lead. The mode of feeding the lead according to this chuck mechanism will be described hereinafter.

In the next place, the mode of advancing and retracting the mechanical pencil unit and the ball point pen unit to the writing position or retracted position in the writing instrument according to this invention will be explained with reference to the developed view of FIG. 10(A).

FIG. 10(A), (*b*), shows a state in which both writing units 3 and 3' are in the retracted position. In this state, the inclined faces of the engaging portions 11 and 11' at the tips of the rods 5 and 5' guided within the guide grooves 10 and 10' of the guide sleeve 9 are respectively abutting elastically against about the middle portion of inclined sliding faces 13 and 13 of the curved casing 8 with the aid of the springs 6 and 6'. And, at this moment, the sector stop 12 at the top of the curved casing 8 is abutting the inclined face 18*b* of the cam 18 of the head portion 16. A chain line shown below the writing units 3 and 3' denotes the position of the tip mouth 29 of the lower barrel 1.

First, in order to advance the ball point pen unit 3' to the writing position, the upper barrel 2, namely the curved casing 8 secured thereto is rotated to the position shown in FIG. 10(A)(*a*). Upon this rotation, the inclined face of the pointed engaging portion 11 of the pencil unit 3 is sliding upwardly along the sliding inclined face 13, and is stopped at the flat portion 15. On the other hand, the pointed engaging portion 11' of the ball point pen unit 3' is sliding downwardly along the sliding inclined face 13 of the curved casing 8, and is engaged with the notched engaging portion 14 at the apex of said sliding inclined faces. At this moment, the sector stop 12 of the curved casing 8 slips into a clearance t formed between the lowermost flat face 18*a* and the top face of the guide sleeve 9. Thus, the curved casing 8 is shifted somewhat lower from the position shown in FIG. 10(A)(*b*). Said clearance t is of such a dimension that the curved casing 8 becomes non-shiftable in the axial direction relative to the guide sleeve 9 when the stop 12 enters said clearance.

In this state of FIG. 10(A)(*a*), the ball point pen unit 3 is brought to the writing position, and the curved casing 8 and the upper barrel 2 secured thereto are engaged so as to be non-shiftable in axial direction.

Next, in order to advance the pencil unit 3 to the writing position, the upper barrel 2, namely the curved casing 8 is rotated to the position shown in FIG. 10(A)(*b*) (180° from the position of FIG. 10(A)(*a*) and 90° from the position of FIG. 10(A)(*b*)). Upon this rotation, the inclined face of the pointed engaging portion 11 of the pencil unit 3 slides down along the sliding inclined face 13 of the curved casing 8, until it is stopped by engaging with the notched engaging portion 14 at the apex of the sliding inclined faces. Thus, the pencil unit 3 is brought to the writing position. On the other hand, the sector stop 12 slides upwardly on the inclined face of the cam 18 to a position 17*a* and is released from the engagement with the cam 18; however, it will abut against the lower end face of the fixing ring 17 fitted on the head portion 16 as shown in FIG. 3(A) and upward escape of the guide sleeve 9 due to the resilience of spring 6 is prevented. Further, as the result of the sector stop 12 being brought to said position, the position of the curved casing 8 relative to the guide sleeve 9 is upwardly shifted corresponding to the shift of the sector stop 12.

As described above, in the state of FIG. 10(A)(*c*), the sector stop 12 is a position 17*a* separated from the inclined face 18*b* of the cam 18 and abuts against the fixing ring 17 by the resilience of springs 6 and 6' and is in a state such that by pushing down the curved casing 8, i.e. the upper barrel 2 in the axial direction, it may be shifted at will to the position shown in FIG. 10(A)(*d*) without any obstruction. Due to the shift of this curved casing 8 in the axial direction, the pencil unit 3 is naturally shifted in the axial direction. In this invention, the distance between the lower face of the sector stop 12 and the top face of the guide sleeve 9, namely, the shifting distance in the axial direction of the sector stop 12 is so determined, in a state shown in FIG. 10(A)(*c*), that the shifting distance of the pencil unit 3 accompanying axial shift of the curved casing 8 becomes sufficient to produce a feeding operation of the lead due to abutment of the abutting stop portion 28 of the pencil unit 3 against the tip mouth 29 of the lower barrel 1. Thus, the curved casing 8, i.e. the upper barrel 2 secured thereto is pushed in the axial direction and released so as to shift reciprocatingly, whereby the feeding operation of the lead of the pencil unit is smoothly and surely effected, resulting in writing being possible.

The feeding of the lead 30 of the mechanical pencil unit 3 will be explained with reference to FIG. 8.

When the pencil unit 3 is brought to the writing position shown in FIG. 10(A)(*c*), and the lower barrel is fixed, the upper barrel 2, i.e. the curved casing 8 is shifted by pushing it in the direction of the arrow, the pencil unit 3 is further shifted downwardly, as shown in FIG. 10(A)(*d*), so that the abutting stop portion 28 of the pencil unit 3 abuts against the mouth 29 of the lower barrel 1. Further, when the curved casing 8 is downwardly pushed and shifted, the connecting sleeve 4 connected with the rod 5 slides toward the tip end of the pencil unit relative to the cover casing 24 against the resilience of the spring 23, because the abutting stop 28 abuts against the mouth portion 29. According to the sliding of the connecting sleeve 4, an intermediate shift sleeve 22 and a split pawl chuck 25 connected thereto are shifted toward the tip end of the pencil unit, whereby the lead 30, which is held by the cooperation of the split pawl chuck 25 with a clamp sleeve 26, is fed toward the tip end of the pencil unit. Further, when the shift of the split pawl chuck 25 toward the tip end of the pencil unit is continued, the clamp sleeve 26, which is shifting with said chuck, abuts against an abutting stop step 3*e* and the shifting of said sleeve is stopped, so that said chuck 25 separates from the clamp sleeve 26 and the lead 30 is released from the holding force of the chuck 25. Thus, the lead 30 is fed a distance corresponding to the shift distance of the clamp sleeve 26. Next, when the load on the curved casing 8, i.e. the pressure on the upper barrel 2 is released, while the lead 30 is being held by an elastic holding ring 27, the chuck 25, the intermediate shift sleeve 22, the connecting sleeve 4 and the rod 5 are shifted back to the original position, and thus the chuck 25 will tightly hold the lead 30 again. By repeating the reciprocating shifting by the pushing of the upper barrel 2, the lead 30 can be fed from a mouth 3*d* of a tip mouth piece 3*b* into a favorable position for writing. Further, spare leads can be stored in a cavity 5*a* in the rod 5, and these spare leads may be continously fed in succession to the lead 30. Replenishment of the spare leads in the cavity 5*a* may be effected by making the connecting sleeve 4 detachable from the rod 5.

The second embodiment of this invention is shown in FIG. 1(B) to FIG. 10(B) inclusive, in which the same reference numerals denote the same parts as in the first embodiment shown in said FIG. 1(A) to FIG. 10(A) inclusive.

The structure of the second embodiment is similar to that of the first embodiment, excepting the configuration of the curved casing 8, the sector stop cam and the relative motion of the pointed engaging portions 11 and 11', and the essential points of difference will be described hereinafter.

As shown in FIG. 1(B) to FIG. 4(B) and FIG. 9(B), the guide sleeve 9 is slidable in the axial direction and rotatably positioned in the curved casing 8. As is apparent particularly from FIG. 9(B) and FIG. 10(B), a sliding cam face 13 is formed on said curved casing 8. As seen from the figures, the sliding cam face 13 has a flat portion 15 at the top as a top portion and a sliding inclined face 13*a* which is inclined from the right end portion of said top portion to the right lower portion thereof, and a notched engaging portion 14 is formed at the lowermost apex of said sliding inclined face 13*a*. This notched engaging portion 14 is so formed that it can be engaged by the tips of pointed engaging portions 11 and 11' which project from the surfaces of the sliders 7 and 7'. Further, the slide cam face 13 comprises an inclined face 13*a'* extending slightly upwardly on the opposite side of the notched engaging portion 14 from the inclined slat face 13*a*, and a vertical face 13*b* rising vertically towards the left end portion of the flat portion 15. The inclined face of said pointed engaging portions 11 and 11' slides along the sliding cam face 13 during the rotation of the curved casing 8. But, since there is provided the vertical face 13*b*, the rotation of the curved casing 8, i.e. the rotation of the upper barrel 2 is limited to only one direction (13*a*→13*a'*→13*b*→15→13*a*).

As described above, the curved casing is so formed that it has the vertical face 13*b* in the sliding cam face 13 so that the casing 8 is rotatable around its axis in one direction (i.e. in the direction of the arrow in FIG. 9(B) ) relative to the guide sleeve 9, and that it is shiftable downwardly in the axial direction within certain limits when the pencil unit 3 is in the writing position, so that the upper barrel 2 is also rotatable only in one direction relative to the lower barrel 1 which is securely connected to the guide sleeve 9, and it is shiftable downwardly in the axial direction within certain limits when the pencil unit 3 is in the writing position.

Next, the mode of advancing and retracting the mechanical pencil unit and the ball point pen unit to the writing position or the retracted position in the second embodiment will be explained with reference to the developed view of FIG. 10(B).

FIG. 10(B)(*b*) shows a state in which both writing units 3 and 3' are in the retracted position. In this state, the inclined faces of the pointed engaging portions 11 and 11' at the tips of the rods 5 and 5' guided within the guide grooves 10 and 10' of the guide sleeve 9 are respectively abutting resiliently against the middle portion of the sliding inclined face 13*a* of the curved casing 8 by the action of the springs 6 and 6'. Further, at this moment, the sector stop 12 at the top of the curved casing 8 is abutting against the inclined face 18*b* of the cam 18 of the head portion 16. A chain line shown below the writing units 3 and 3' denotes the position of the tip mouth 29 of the lower barrel 1.

First, in order to advance the pencil unit 3 to the writing position, the upper barrel 2, i.e. the curved casing 8 is rotated to the position shown in FIG. 10(B)(*c*) (in the direction of the arrow X). During this rotation, the inclined face of the pointed engaging portion 11 of the pencil unit 3 slides downwardly along the sliding inclined face 13*a* until the apex engages with the notched engaging portion 14 thereon. At this time, the stop 12 of the curved casing 8 slides along the inclined face 18*b* of the cam 18 and is positioned at a portion 17*a* having no cam face. In consequence, the curved casing 8 rises in the direction of the arrow y from the position shown in FIG. 10(B)(*b*) to the position shown in FIG. 10(B)(*c*). Therefore, the pointed engaging portion 11' of the ball point pen unit 3' is gradually moving away from the flat portion 15 of the curved casing 8 to reach a position shown in FIG. 10(B)(*c*). Since the sector stop 12 of the curved casing 8 is positioned at a portion 17*a*, the top face of said stop abuts against the lower face of the fixing ring 17 due to the resilience of the spring 6, and an interval d exists between the top face of the guide sleeve 9 and the lower face of the stop 12 (FIG. 10(B)(*c*)). This interval d is so determined that it corresponds to the shifting distance (knocking distance) in the downward axial direction of the upper barrel 2, i.e. the curved casing 8 for the feeding out of the lead. In the state shown in FIG. 10(B)(*c*), the pencil unit 3 is in the writing position.

As described above, the sector stop 12 of the curved casing 8 abuts against the lower face of the fixing ring 17 due to the resilience of the spring 6 to maintain the interval d, and by pushing the upper barrel 2, i.e. the curved casing 8 downwardly in the axial direction (in the direction of the arrow z), it can be shifted to the position shown in FIG. 10(B)(*d*) at will without any obstruction. Due to the shifting in the direction of arrow z of this curved casing 8, the pencil unit 3 is naturally shifted in the direction of arrow z. As described above, the interval d is so determined that the shifting distance of the pencil unit 3 accompanying the shifting of the curved casing 8 in the axial direction (in the direction of arrow z) becomes such as to enable the feeding out of the lead due to the abutment of the abutting stop portion 28 of the pencil unit 3 against the tip mouth 29 of the lower barrel 1. Thus, by pushing in the axial direction, releasing and reciprocatingly shifting the curved casing 8, i.e. the upper barrel 2 secured thereto, the feeding operation of the lead of the pencil unit is smoothly and surely effected, making writing possible.

Next, in order to advance the ball point pen unit 3' to the writing position, the curved casing 8 is rotated to the position shown in FIG. 10(B)(*a*) and the pointed engaging portion 11' of the ball point pen unit 3' is made to engage with the notched engaging portion 14 at the apex of sliding inclined face 13*a* of the curved casing 8. The movement of the pencil unit 3 and the ball point pen unit 3' as well as the shifting of the curved casing 8 in the axial direction to the positions shown in FIG. 10(B)(*a*) will be omitted, because they are apparent from the explanation with reference to FIG. 10(B)(*d*) and FIG. 10(B)(*c*). On the other hand, when the parts are in the state as in this FIG. 10(B)(*a*), the sector stop 12 enters the clearance t between the top portion of the guide sleeve 9 and the lowermost flat face 18*a* of the cam 18. The dimension of this clearance t is such that the curved casing 8 is not shiftable in the axial direction relative to the guide sleeve 9 when the stop enters said clearance.

As described above, according to this invention, the pencil unit and the ball point pen unit can be smoothly and surely brought to the writing position and the retracted position selectively by rotating the upper barrel in one or both directions and a lead feeding operation can be effected by shifting the upper barrel in the axial direction, whereby a compound writing instrument having a very simple structure and excellent durability can be provided.

What is claimed is:

1. A compound writing instrument comprising a lower barrel accomodating a retractable mechanical pencil unit and a ball point pen unit; an upper barrel rotatable in one or both directions relative to said lower barrel around its axis and overlapping the upper portion of said lower barrel; a cam mechanism in said upper barrel including a curved casing engaging said units for selectively shifting said units in the axial direction into a writing position when said upper barrel is rotated, said cam mechanism permitting said upper barrel to shift relative to said lower barrel in the axial direction enough to feed out the lead in said mechanical pencil unit when this unit is in the writing position, while said upper barrel is made non-shiftable relative to said lower barrel when said ball point pen unit is in the writing position.

2. A compound writing instrument according to claim 1, in which said lower barrel has an opening in its one end; said mechanical pencil unit and said ball point pen unit being acomodated within said lower barrel with their writing means being directed toward said opening; said instrument further comprising a guide sleeve with one end inserted into the opening at the other end of said lower barrel and having two guide grooves therein extending in the axial direction, said guide grooves being placed around said sleeve about 180°, and sliders provided on the upper portion of said writing units and being guided within said guide grooves; said curved casing having a sliding cam face against which the engaging portions of said sliders abut, said sliding cam face having a flat portion at the top and a sliding inclined face on at least one end of said flat portion in the direction of rotation of said upper barrel; a sector stop provided on the top portion of said curved casing; said sector stop engaging with a stop cam face on the peripheral surface of a head portion of said guide sleeve; and said upper barrel surrounding said curved casing and being tightly secured thereto.

3. A compound writing instrument according to claim 2, wherein said sliding cam face has an inclined sliding face on both sides of said flat portions, whereby said barrel is rotatable in both directions.

4. A compound writing instrument according to claim 2, wherein said sliding cam face has an inclined sliding face on one side of said flat portion and an upright face on the other side thereof, whereby said barrel is rotatable only in one direction.

* * * * *